United States Patent [19]

Kitner

[11] Patent Number: 4,641,939

[45] Date of Patent: Feb. 10, 1987

[54] AUTOMATIC FILM THREADING APPARATUS FOR ROLL-FILM PROCESSORS

[75] Inventor: William M. Kitner, Inglewood, Calif.

[73] Assignee: Vari-X, Irvine, Calif.

[21] Appl. No.: 702,983

[22] PCT Filed: May 11, 1983

[86] PCT No.: PCT/US83/00746

§ 371 Date: Feb. 11, 1985

§ 102(e) Date: Feb. 11, 1985

[87] PCT Pub. No.: WO84/04603

PCT Pub. Date: Nov. 22, 1984

[51] Int. Cl.[4] ..... G03D 3/13

[52] U.S. Cl. ..... 354/313; 354/316; 354/321; 354/322; 354/338; 226/91

[58] Field of Search ..... 354/310, 312, 313, 314, 354/316, 319, 320, 321, 322, 345, 338; 226/91, 92; 134/64 P, 122 P

[56] References Cited

U.S. PATENT DOCUMENTS

| | | | |
|---|---|---|---|
| 1,946,841 | 2/1934 | Ybarrondo | 354/321 |
| 2,770,179 | 11/1956 | Dye et al. | 354/320 |
| 2,914,999 | 12/1959 | Jamieson | 354/321 |
| 3,178,124 | 4/1965 | Trout et al. | 354/321 |
| 3,195,438 | 7/1965 | Woodcock | 354/321 |
| 3,810,568 | 5/1974 | Kwiaikowski et al. | 354/310 |
| 4,045,809 | 8/1977 | Landers | 354/322 |
| 4,065,042 | 12/1977 | Zielinski | 354/321 |
| 4,067,034 | 1/1978 | Kwiatkowski | 354/310 |
| 4,067,035 | 1/1978 | Plursch et al. | 354/313 |
| 4,068,250 | 1/1978 | Anderson et al. | 354/312 |
| 4,072,260 | 2/1978 | Dove | 354/345 |
| 4,131,356 | 12/1978 | Schmidt | 354/322 |
| 4,140,383 | 2/1979 | Schmidt | 354/316 |
| 4,188,108 | 1/1980 | Falomo | 354/345 |
| 4,279,371 | 7/1981 | Laar et al. | 354/345 |

*Primary Examiner*—A. A. Mathews

*Attorney, Agent, or Firm*—Albert O. Cota

[57] ABSTRACT

An automatic film threading apparatus (10) that allows roll-film (58) to be automatically threaded through a series of film developing and processing chambers (**12*a*) located on a roll-film processor (50). The apparatus is further comprised of a powered film spool (52*a*) and a pinch roller (16*a*) disposed above the spool to form a rolling intersection. A spool and roller combination is located between the upper ports (12*b*) of each chamber pair. Also located above and below each chamber pair is an upper and a lower film guide (18) (56). Automatic threading is accomplished by extracting a small section of film (58) from its reel (14*b*) and attaching the film to one end of a threading leader assembly (15). The other end of the threading leader is then manually threaded through a first chamber pair where a threading tip (15*c*) engages the rolling intersection of the roller (16*a*) and spool (52*a*). From this point on, the film (58) is automatically threaded through each successive chamber (12*a***).

18 Claims, 14 Drawing Figures

Fig.1.
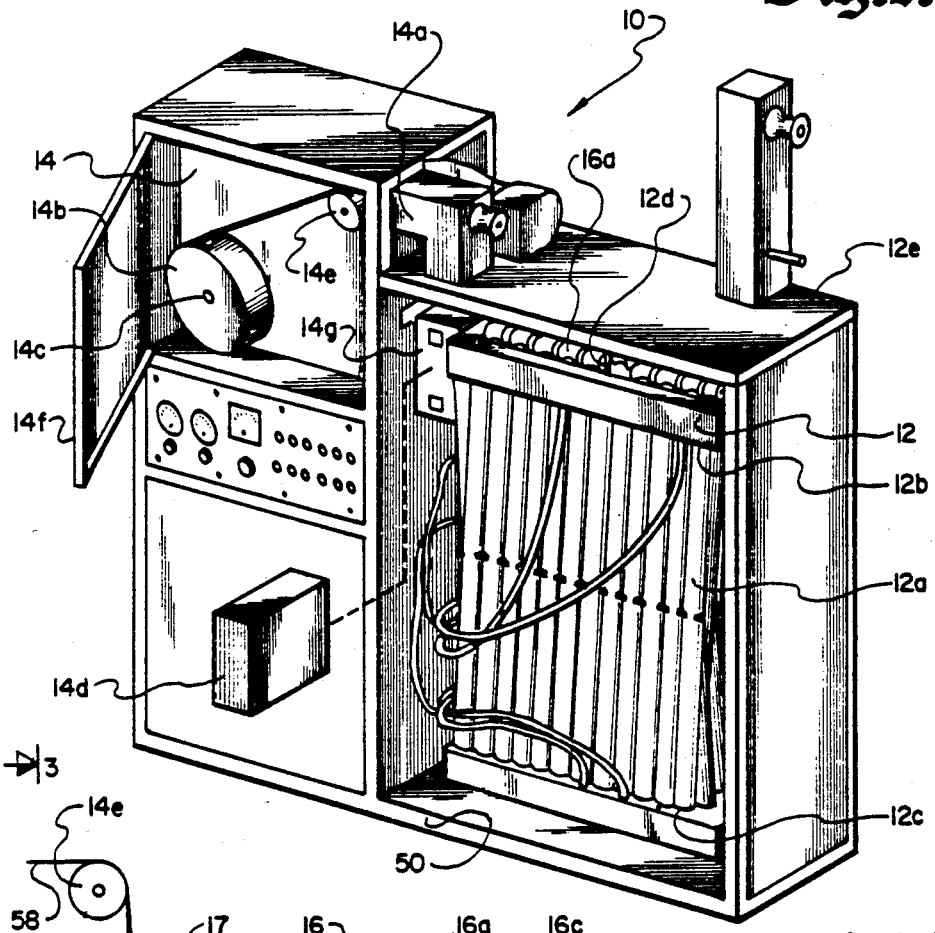
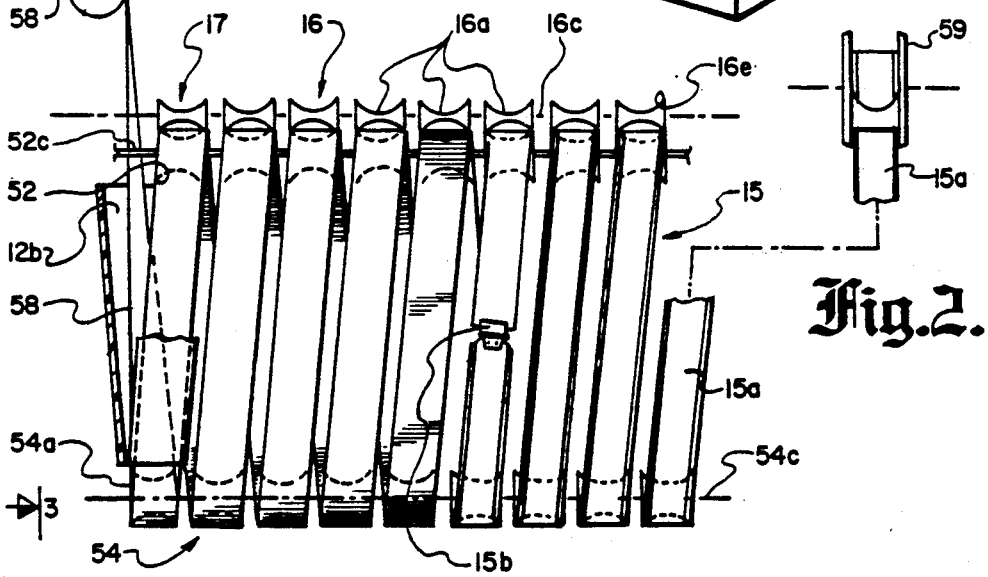
Fig.2.

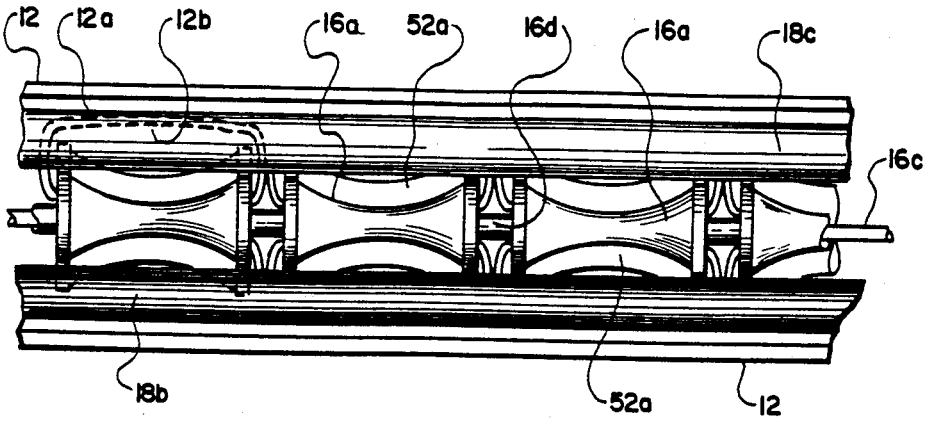
Fig.8.
Fig.9.
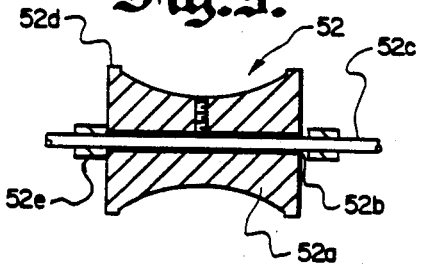
Fig.10.
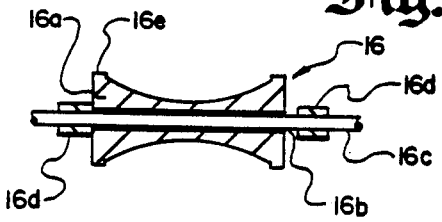
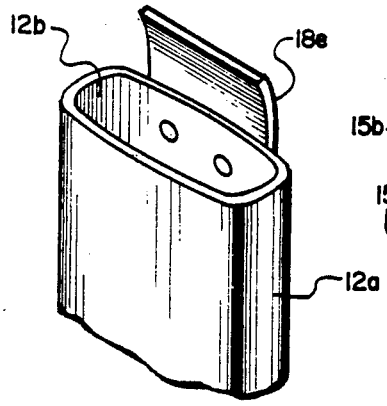
Fig.11.
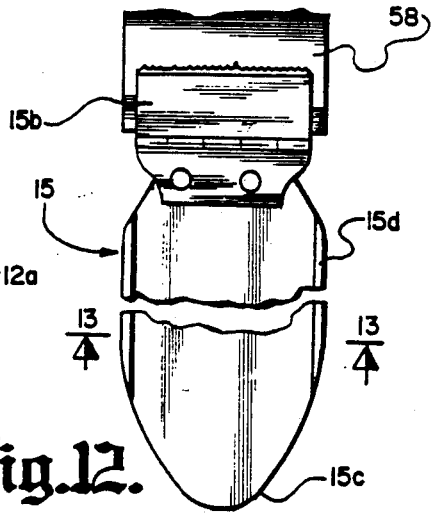
Fig.12.
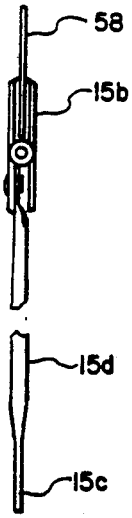
Fig.14.
Fig.13.
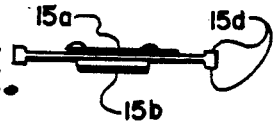

AUTOMATIC FILM THREADING APPARATUS FOR ROLL-FILM PROCESSORS

TECHNICAL FIELD

The invention pertains to the general field of roll-film processors and more particularly to processors that incorporate an automatic film threading apparatus.

BACKGROUND ART

The automatic film threading apparatus is primarily designed to be used with film processors of the type having a plurality of chemically-filled film developing and processing chambers arranged in pairs and in parallel rows. Each chamber has an upper port and a lower port where the film is caused to sequentially be transported through each of the chambers until the developed film exits at the upper port of the final chamber.

Most film processors have a film loading compartment where there is usually located a film input port, an exposed film spindle and a leader spindle having a first take-up reel loaded with leader film. Within each of the film developing and processing chambers is also located a contiguous strip of leader film where one end of the leader projects out of the first chamber and into the film input port in the loading compartment and where the other end is attached to a second leader take-up reel located near the upper port of the final chamber. The current method used to load the exposed film into the processor requires the following steps:

1. The exposed film is initially rolled onto a daylight film reel. The reel is then inserted into the exposed film spindle located in the film loading compartment.

2. The end of the exposed film is attached to the end of the leader film projecting from the upper portion of the first take-up reel. The attachment is accomplished by manually splicing the two ends of the respective films with non-corrosive staples.

3. The door on the film loading compartment is then closed, to avoid film exposure, and a first take-up reel switch is activated to wind the exposed film onto the first take-up reel.

4. After step three is completed the film loading compartment door is opened. The end of the leader film projecting from the first take-up reel, that now has the exposed film embedded at the core of the reel, is then spliced to the end of the leader film projecting out of the film input port. The splicing is accomplished by manually attaching the two ends of the respective leader films with non-corrosive staples. After the compartment door is closed the film processing commences when a second take-up reel switch is activated causing the leader film with the attached exposed film to be pulled through each successive developing and processing chamber.

5. At the end of the processing cycle the developed film, which is now wound on the upper portion of the second take-up reel, is transferred from the second take-up reel to a final viewing reel.

The above-described loading procedure is not cost-effective in terms of materials and manhours used. Because of the quantity of steps required for loading and processing the exposed film there is the possibility that the exposed film may be damaged and/or inadvertently exposed. Additionally, if the staple splice is not properly aligned the film may bind or twist within the processor causing the film to break.

A search of the prior art did not disclose any patent that read on the claims of the instant invention. However, the following U.S. patents are typical of the current state-of-the-art in film processors and film transport mechanisms.

| U.S. PAT. NO. | INVENTOR | ISSUED |
|---|---|---|
| 4,131,356 | Schmidt | 26 December 1978 |
| 4,068,250 | Anderson, et al | 10 January 1978 |
| 4,045,809 | Landers | 30 August 1977 |

The Schmidt patent discloses a film processor which includes a sheet transport having a finger pushing the rear edge of the film sheet. The fingers work in conjunction with edge guides that guide the edges of the , film along a path that leads down into a series of tanks and up and out of each tank in a loop over to the next tank, including a loop guide located at the end of each loop for guiding the film sheet around the loop.

The Anderson patent discloses a leader belt stabilizer for use on film processors. The belt is designed to maintain the desired orientation of the belt by removing any twists in the belt and straightening out the clip and the attaching arm immediately prior to the belt passing around the guiding rollers of the belt transport system.

The Landers patent discloses a film processor that uses magnetic carriages that mount releasable film grips that grip the film in a trailing relation to the carriages. The carriages are actuated by a magnetic element mounted for reciprocation within the developing chambers.

DISCLOSURE OF INVENTION

The automatic film threading apparatus allows roll-film to be automatically threaded through a series of film developing and processing chambers located on a roll-film processor. The apparatus can be used as a kit for retro-fitting existing non-automatic threading processors or can be incorporated into the original processor design. In either case the apparatus is cost-effective in terms of materials and manhours saved.

The apparatus is basically comprised of a series of film developing and processing chambers, a pinch roller, a powered film spool, an upper and a lower film guide, and a threading leader assembly. The pinch roller is disposed above the powered film spool to form a rolling intersection and both elements are located between the upper ports of a film developing and processing chamber pair. Above and below the ports of each chamber pair is also located the upper film guide and lower film guide respectively. These elements guide the exposed film via the threading leader assembly in and out the upper and lower ports of each chamber pair.

To operate the apparatus a small section of exposed film is extracted from the exposed film reel mounted on a spindle in the apparatus and the film is attached to one end of the threading leader assembly. The other end of the threading leader is then manually threaded through the upper and lower ports of a first single chamber, into the lower and out the upper port of the second chamber of the first chamber pair where the threading tip of the threading leader engages the rolling intersection of the first pinch roller and powered film spool. From this point on, the exposed film is automatically threaded through each successive film developing and processing chamber.

In addition to providing an improved and simplified method for automatically threading roll-film into a roll-film processor and eliminating many of the operating steps and materials needed in current processor designs, it is also an objective of the invention to provide an apparatus that:

- eliminates the need for the first and second leader take-up reels as described in the BACKGROUND ART section,
- eliminates having leader film threaded through each film developing and processing chamber,
- eliminates the need for twice stapling the exposed film to the leader film, and
- reduces and eliminates the incidents of film breaks during the developing cycle.

BRIEF DESCRIPTION OF DRAWINGS

FIG. 1 is a perspective view of an overall roll-film processor equipped with the inventive apparatus.

FIG. 2 is a side view showing the film path from the beginning to the end of the film developing cycle.

FIG. 8 is a top view of a typical section of a film developing and processing chamber pair and associated elements.

FIG. 9 is a cross-sectional view of a single powered film spool assembly.

FIG. 10 is a cross-sectional view of a single pinch roller assembly.

FIG. 11 is a perspective view of an upper port of a developing and processing chamber showing one of the inside film guides attached.

FIG. 12 is a top view of the threading leader assembly shown with the spring clip attached to the film.

FIG. 13 is an end view of the threading leader assembly.

FIG. 14 is a side view of the threading leader assembly.

BEST MODE FOR CARRYING OUT THE INVENTION

Figure 3:
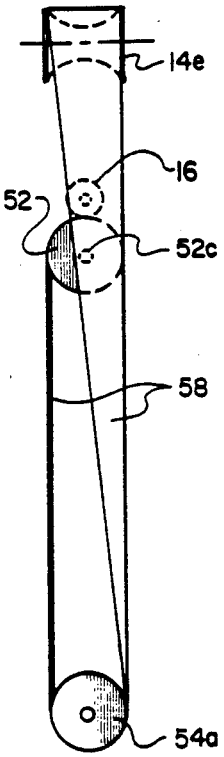
FIG. 3 is an end view taken along section 3—3 of FIG. 2.

The best mode for carrying out the Automatic Film Threading Apparatus for Roll-Film Processors 10 is described in terms of a single preferred embodiment. In this embodiment the apparatus 10 is amenable for incorporation into the basic design of a new roll-film processor 50 or as a retrofit kit for modifying existing film processors 50 not having automatic film threading capability.

The apparatus 10 is comprised of five major inventive elements: a film development compartment 12, a film loading compartment 14, a threading leader assembly 15, a pinch roller assembly 16, and an upper film guide assembly 18. The above elements are used in combination with a powered film spool assembly 52, a bottom film roller assembly 54, and a lower film guide 56. Each of the elements are structurally described followed by an operation section that discusses the operation and interrelationship of the elements.

Figure 5:
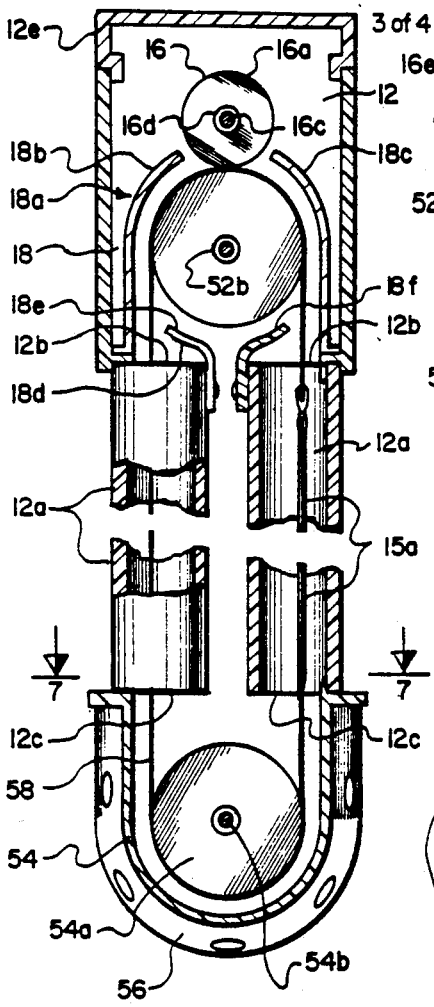
FIG. 5 is a cross-sectional end view of a typical chamber and associated elements.

The film development compartment 12, as shown in FIGS. 1 and 5 houses a plurality of film developing and processing chambers **12*a*. The chambers are filled with film developing and fixing fluids, of a type well known in the art, and the exposed film 58 is allowed to pass through each successive chamber, as shown in FIGS. 2 and 3, until the film is developed and rolled onto a final viewing take-up reel 59**.

Figure 4:
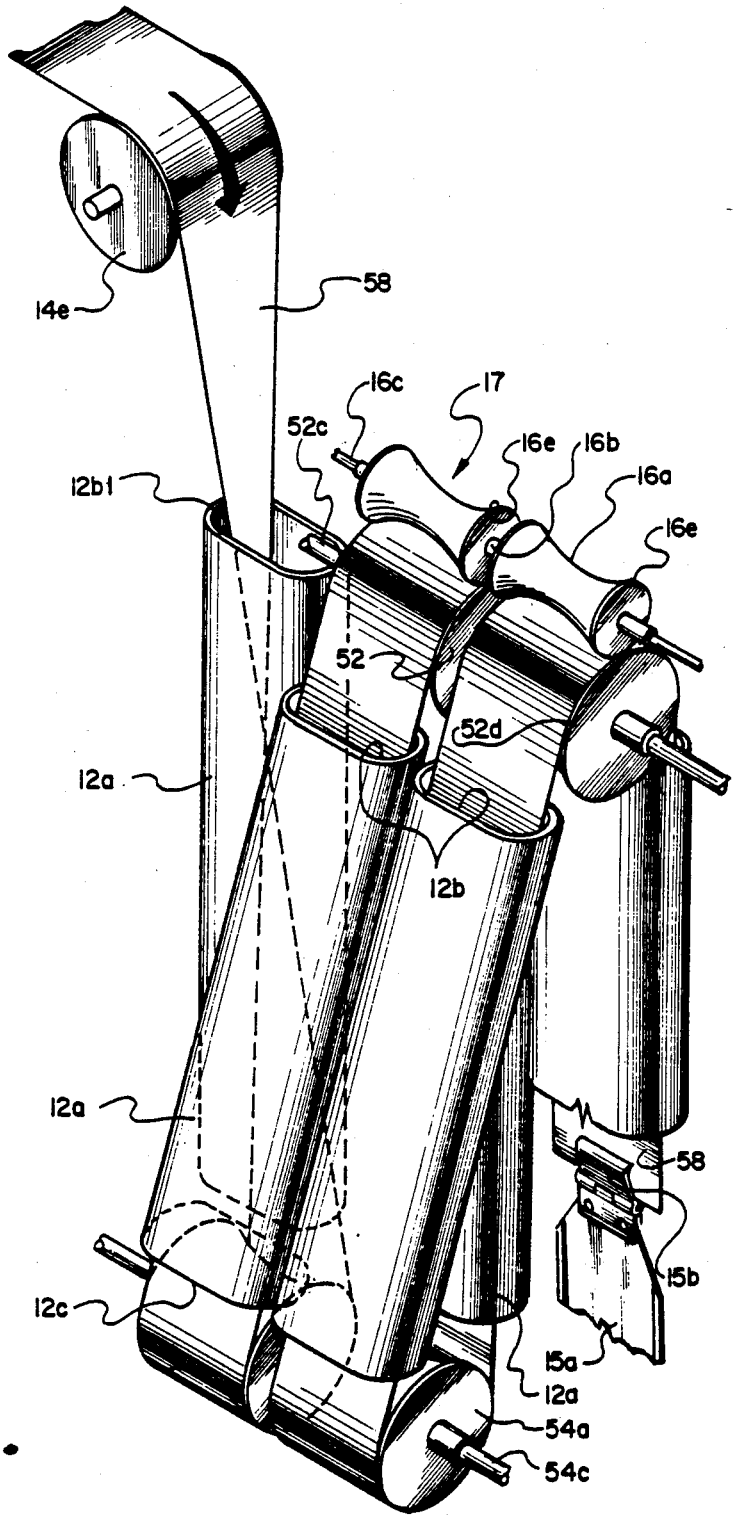
FIG. 4 is a perspective view showing the threading leader assembly and film being transported through the single chamber and two subsequent chambers pair.

Each individual chamber, as shown in FIGS. 4, 5, 6 and 7, has in the preferred embodiment, an eliptical cross section having an upper port **12*b* and lower port 12*c*. Although the chamber groupings may vary, in a typical embodiment, there are a total of three parallel chamber groups where each group is comprised of ten pairs of chambers 12*a* arranged in vertical offset rows. The first chamber group, however, differs from the other two in that in the beginning of this group there is located an additional single chamber 12*a*, as best shown in FIG. 4, having an upper port 12*b*1 and a lower port 12*c*1. The upper port 12*b*1 is the initial port into which is inserted the exposed film 58 via the threading leader assembly 15. On every chamber group there is located a squeegee 12*d* that is used to clean and semi-dry the film before insertion into the next chamber 12*a*. During the developing cycle the film developing compartment 12 is covered with a removable dark cover lid 12*e* as shown in FIGS. 1 and 4** to insure that no light penetrates into the development compartment.

The second element is a film loading compartment 14, as also shown in FIG. 1, that is used to initially load the exposed film into the roll film processor 50. The compartment 14 is located in an easily accessible area of the processor 50 and incorporates, in part, a film input port **14*a* located near the entrance to the upper port 12*b*1 of the single film developing and processing chamber. Two film loading implements are disclosed—one uses a combination of an exposed film reel 14*b* and a film guide roller 14*e*, and the other an exposed film cartridge 14*d***.

To accommodate the reel **14*b* the compartment 14 is equipped with an exposed film spindle 14*c* into which is inserted the reel 14*b*. A small length of exposed film is then extracted from the reel and fed into the input port 14*a* via a threading leader assembly 15. The film compartment is equipped with a light proof door 14*f* that is closed after the exposed film is inserted into the input port 14*a***.

To use the film cartridge **14*d* an exposed film cartridge attachment means 14*g* is employed. The cartridge may be of any design as long as the film exit surface of the cartridge is compatible with the mating surface of the attachment means so that once attached no light enters into the two attachment surfaces. Additionally, the attachment means 14*g* should be located near the first upper port 12*b*1 to minimize the amount of exposed film that must initially be extracted from the cartridge and fed into the upper port via the threading leader assembly 15**.

The threading leader assembly 15, as shown in FIGS. 12, 13 and 14 is attached to the end of the exposed film 58 protruding from the reel **14*b* or cartridge 14*d* and functions to lead the film through each successive film developing and processing chamber 12*a*. The assembly 15 is comprised of a flexible strip 15*a* that is made of a thin flexible material with a non-corrosive metal i.e., stainless steel preferred. On one end of the strip 15*a* is conventionally attached a spring clip 15*b* also made of a non-corrosive metal. On the other end of the strip 15***a* is a contiguous threading tip 15*c* that is shaped in a smooth curve to allow the tip to be easily inserted through the film input port 14*a* and threaded into the first and subsequent film developing and processing chamber ports. The automatic threading does not commence until the threading tip 15*c* is inserted into the rolling intersection of the first powered film spool 52*a* and pinch roller 16*a* located at the upper ports 12*b* of the first film developing and processing chamber pair 17 as best shown in FIG. 4. Therefore, the length of the threading leading assembly 15 is dependent on and must have a length equivalent to at least two chamber lengths plus the distance from the upper port 12*b*1 of the first single chamber to the attachment point of the assembly 15 and film 58. A typical threading leader assembly 15 has a length of 100 inches (254.0 cm) and a width equal to the gripping edges of the pinch roller and powered film spool.

In an alternative design, the threading leader assembly 15 may have the upper and/or lower edge 15*d* on each side of the strip thicker than the strip center. With this design there is further assurance that the film emulsion will not be damaged if the face of the film should touch the surface of a pinch roller 16*a* or powered film spool 52.

Figure 6:
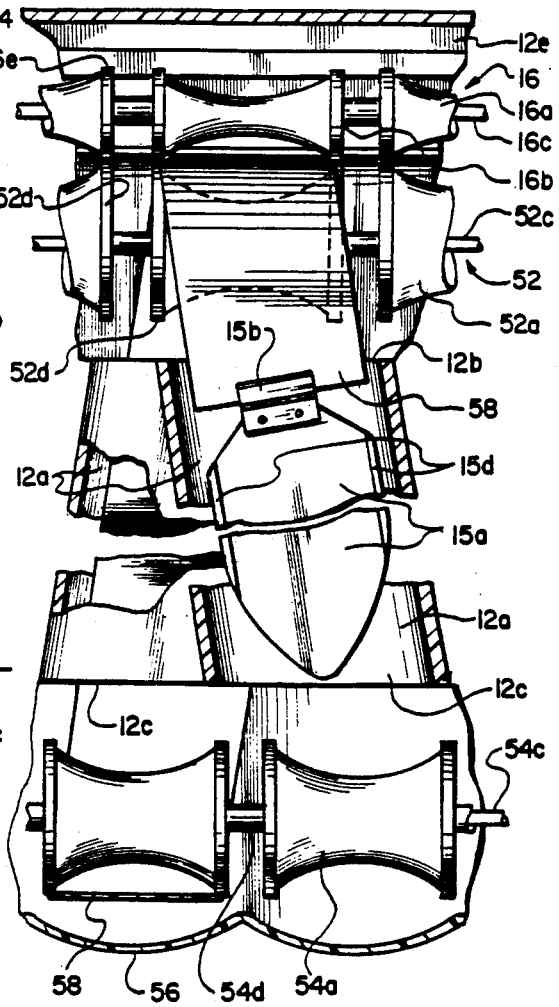
FIG. 6 is a cross-sectional view showing two typical chambers in their offset position.
Figure 7:
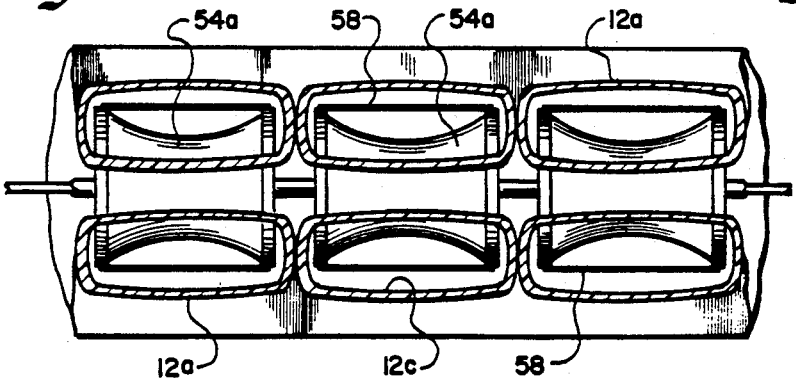
FIG. 7 is a sectional view taken along section 7—7 of FIG. 5.

The basic elements that allow the automatic film threading to operate, as shown in FIGS. 4, 5 and 6, is the combination of the pinch roller assembly 16 and the powered film spool assembly 52.

The powered film spool assembly 52 is comprised of a plurality of powered film spools 52*a* that are rigidly attached through a powered film spool bore 52*b* to a single powered film spool axle 52 that rotates typically at a speed of 106 revolutions per minute (rpm). The axle is equipped with spacers 52*e* and conventionally attached to a structural member in the film development compartment 12 with a spool located, as best shown in FIG. 8, above and between the upper ports 13*b* of a film developing and processing chamber pair.

In the preferred embodiment the spools, when viewed from the end, are circular and when viewed from the side, as best shown in FIG. 6, have an upper and lower concave shape with the edges of the spool having a flat circumferential surface 52*d*. For every chamber group, in a typical configuration, there are ten powered spools and since there are three chamber groups per film processor 50 a total of thirty spools are required for each processor. Ten powered axles 52*a* are also required per processor with each axle traversing across the three chamber groups and accommodating four power spools 52*a*.

The pinch roller assembly 16 is comprised of a plurality of pinch rollers 16*a* and a single fixed pinch roller axle 16*c* equipped with spacers 16*d*. The pinch roller has a centrally located pinch roller axle bore 16*b* having a diameter that is sized to allow the roller to rotate freely about the axle 16*c*. In the preferred embodiment the rollers when viewed from the ends are circular and when viewed from the sides as best shown in FIG. 6, have an upper and lower concave shape with the edges of the rollers having a flat circumferential surface 16*e*. The flat edges of the rollers are aligned with the respective flat edges on the powered film spools and with the thicker edges of the threading leader assembly 15.

Each pinch roller 16*a* as shown in FIGS. 5 and 6 is located directly above a respective powered film spool 52*a*. The distance between the pinch roller and powered film spool is set an optimum distance to allow the two respective edges of the pinch roller and film spool to firmly grip and pull the threading leader assembly 15 through each successive pinch roller and film spool combination.

To allow the exposed film 58 to continue travelling smoothly out of and into the lower ports 12*c* of a film developing and processing chamber pair a bottom film roller assembly 54, as shown in FIGS. 5 and 6, is employed. This assembly is comprised of a plurality of film rollers 54*a* that are similar in construction and shape as the powered film spools 52*a*. Each roller has a centrally located film roller axle bore 54*b* that is sized to allow the roller to rotate freely about a single fixed film roller axle 54*c* having spacers 54*d*. The axle is conventionally attached to a lower structural member in the film development compartment 12. As best shown in FIG. 4, there is one film roller assembly 54, centrally located below and between the lower ports 12*c* of each film developing and processing chamber pair.

To assure that the threading leader assembly 15 and the attached exposed film 58 are accurately guided in and out of the upper and lower ports 12*b*, 12*c* of the respective film developing and processing chamber 12*a* an upper film guide assembly 18 and a lower film guide 56 are employed.

The upper film guide assembly 18, as shown in FIGS. 4 and 8, is comprised of an outside film guide 18*a* and an inside film guide 18*d*. The outside film guide is further comprised of a first curved segment 18*b* and a second curved segment 18*c* where both segments are similarly dimensioned and constructed of a noncorrosive metal or plastic. The two segments 18*b*, 18*c* are designed to partially bridge the upper ports 12*b* of a film developing and processing chamber pair when the segments are attached. The inside lower section of each segment is attached to the outer edge of the respective upper port 12*b* by means of a set of screws or bolts or the segments may be designed with a groove sized to allow the segments to rest-fit into a convenient structural member of the apparatus 10. Each curve segment curves inwardly following the circumference of the powered film spool 52*a* with the upper end of the curve located just above the rolling intersection of the respective power spool 52*a* and pinch roller 16*a*.

The inside film guide 18*d*, as shown in FIGS. 5 and 11 is further comprised of a first guide 18*e* and a second guide 18*f* where both guides are similarly dimensioned and constructed of a non-corrosive metal or plastic. The two guides 18*e*, 18*f* are attached to the inside outer edge of their respective upper ports 12*b*. The attachment may be accomplished by means of screws or bolts or, as with the curved segments of the upper film guide 18, the guides may be designed with a lower groove sized to allow the guides to rest-fit into the edge of the port 12*b*. Each guide shape follows the circumference of the powered film spool 52*a* with the upper end of the guide curve located near but not touching the film 58 being processed.

An alternative outside film guide (not shown) may be comprised of a single curved section where the curve is sized to allow the edges to be located and attached to a structural member near the upper ports of each film developing and processing chamber pair. The single curved section has an opening that allows a corresponding pinch roller 16*a* to protrude through the opening and rotate freely.

With the configuration of the upper film guide assembly, the threading leader 15 and the attached film 58 are accurately guided out the upper port 12b of the chamber 12a, into and out of the rolling intersection of the power spool 52a pinch roller 16a, and into the upper port 12b of the adjacent chamber 12a.

The lower film guide 56, as also shown in FIGS. 5 and 6, is comprised of a single curved section constructed of a non-corrosive metal or plastic. The guide 56 is designed to bridge the lower ports 12c of a film developing and processing chamber pair. The inside edges of the curved section are conventionally attached near the outer edge of the respective lower port 12c. The curve of the guide 56 is designed to lay below and follow the curvature of the powered spool 52a such that the threading leader 15 and the attached film 58 are smoothly guided out one lower port 12c and into the adjacent lower port 12c of a film developing and processing chambers pair.

OPERATION

To practice the invention 10 the following steps are performed:

1. Insert an exposed film reel 14b into the exposed film spindle 14c located in the film loading compartment 14.

or

Attach an exposed film cartridge 14d to the exposed film cartridge attachment means 14g.

2. Extract a small section of exposed film 58 from the reel or cartridge.

3. Attach the spring clip 15b located on one end of the threading leader assembly 15 to the extracted film from the reel or cartridge.

4. Insert the threading tip 15c of the threading leader assembly 15 through and out of the film input port 14a. If a reel is being used, close the light proof door 14f on the film loading compartment 14.

5. Grasp the threading tip 15c projecting out the film input port and manually thread the threading tip into the upper port 12b1 of the single film developing and processing chamber 12a located at the beginning of the first chamber group.

6. Continue threading the threading leader assembly out the lower port 12c1 of the single chamber, into the lower port 12c of the second chamber, out the upper port 12b of the second chamber and into the rolling intersection of the first pinch roller 16a and first powered film spool 52a located at the upper ports 12b of the first chamber pair 17 of the first chamber group. From this point on the threading leader assembly and the exposed film are automatically threaded through the remaining film developing and processing chambers until the developed film exits out the upper port of the final chamber. When the film exits an alarm is energized at which time the operator turns-off the film processor.

7. Remove the developed film from the threading leader assembly and wind the film onto the final viewing reel 59.

Although the invention has been described in complete detail and pictorially shown in the accompanying drawings, it is not to be limited to such details, since many changes and modifications may be made to the Automatic Film Threading Apparatus for Roll-Film Processors without departing from the spirit and scope thereof. Hence, it is described to cover any and all modifications and forms which may come within the language and scope of the claims.

I claim:

1. An automatic film threading apparatus for roll-film processors comprising:

(a) a roll-film processor comprising in part:

(1) a film developing compartment comprising a plurality of film developing and processing chambers with each chamber having an upper port and a lower port, (2) a film loading compartment having means to accept and retain exposed film and also having a film input port located near the entrance to the upper port of the first developing and processing chamber, (3) a powered film spool assembly consisting of a plurality of powered film spools rigidly attached to a powered film spool axle where each spool is centrally located above and between the upper ports of a film developing and processing chamber pair, (4) a bottom film roller assembly consisting of a plurality of film rollers rotatably attached to a fixed bottom film roller axle where said bottom film roller assembly is centrally located below and between the lower ports of a film developing and processing chamber pair, (b) a threading leader assembly consisting of a flexible strip having on one end the means for attaching to the end of the exposed film and on the other end a threading tip that is initially inserted through the film input port on said film loading compartment, (c) a pinch-roller assembly comprising a plurality of pinch rollers rotatably attached to a fixed pinch roller axle where a pinch roller is located and attached directly above each powered film spool at a distance that allows the combination of the pinch roller and film spool to firmly grip and pass said threading leader assembly, (d) means for accurately guiding said threading leader assembly and the attached exposed film out the upper port of one film developing and processing chamber, between a pinch roller and powered film spool, and into the upper port of the following film developing and processing chamber, and (e) means for accurately guiding said threading leader assembly and the attached exposed film out the lower port of one film developing and processing chamber, below the bottom film roller and into the lower port of the following film developing and processing chamber.

2. The apparatus as specified in claim 1 wherein said plurality of film developing and processing chambers are arranged in groups, where on group is comprised of a plurality of said chamber pairs arranged in vertical offest rows and where the groups, when viewed from the top, are arranged in parallel rows, and with each of said chambers having an upper port and a lower port.

3. The apparatus as specified in claim 2 further comprising a single chamber located at the beginning of the first chamber group with said single chamber having an upper port and a lower port where into the upper port is initially inserted the exposed film.

4. The apparatus as specified in claim 1 wherein said film loading compartment incorporates a spindle for attaching a reel of exposed film.

5. The apparatus as specified in claim 1 wherein said film loading compartment incorporates a means for attaching an exposed film cartridge.

6. The apparatus as specified in claim 1 wherein the means for ataching the end of the exposed film to one end of said threading leader assembly is by a non-corrosive spring clip attached to one end of said leader.

7. The apparatus as specified in claim 1 wherein the means for guiding said threading leader out the upper port of one film developing and processing chamber, between a pinch roller and powered film spool, and into the upper port of the following film developing and processing chamber is accomplished by an upper film guide assembly comprised of a combination of an outside film guide and an inside film guide where the combination is located and attached to the two respective upper ports of a film developing and processing chamber pair.

8. The apparatus as specified in claim 1 wherein the means for guiding the threading leader out the lower port of one film developing chamber, below the bottom film roller and into the lower port of the following film developing and processing chamber is accomplished by a lower film guide located and attached to the two respective lower ports of a film developing and processing chamber pair.

9. An automatic film threading apparatus for roll-film processor comprising:

(a) a roll-film processor comprising in part:
  (1) a plurality of film developing and processing chambers with each chamber having an upper port and a lower port,
  (2) a film loading compartment having means to accept and retain exposed film and also having a film input port located near the entrance to the upper port of the first developing and processing chamber,
  (3) a powered film spool assembly comprising a plurality of powered film spools rigidly attached to a single powered film spool axle where each spool is centrally located above and between the upper ports of a film developing and processing chamber pair,
  (4) a bottom film roller assembly consisting of a plurality of film rollers rotatably attached to a fixed bottom film roller axle where said bottom film roller assembly is centrally located below and between the lower ports of a film developing and processing chamber pair, (b) a threading leader assembly comprising a flexible strip having on one end a spring clip and on the other end a threading tip where the spring clip attached to the end of the exposed film and where the threading tip is shaped to allow it to be easily inserted through the film input port and threaded into the first and subsequent film developing and processing chamber ports, (c) a pinch-roller assembly comprising a plurality of pinch rollers having a centrally located pinch roller axle bore that allows the pinch roller to be rotatably attached to a single fixed pinch roller axle where each pinch roller in located directly above a respective powered film spool with the distance between the pinch roller and film spool is set at an optimum distance to allow said threading leader assembly to be firmly gripped at its two edges and passed through each successive pinch roller and powered film spool combination, (d) an upper film guide assembly comprised of an outside film guide and an inside film guide where:
  (1) the outside film guide is further comprised of a first curved segment and a second curved segment that are similarly dimensioned and constructed and where the two segments when attached, are designed to partially bridge the upper ports of a film developing and processing chamber pair, where the inside lower section of each segment is attached to the outside outer edge of their respective upper ports and where the segments curve inwardly following the circumference of said powered film spool with the upper end of the segment curve located just above the rolling intersection of the respective power spool and the pinch roller,
  (2) the inside film guide is further comprised of a first guide and a second guide that are similarly dimensioned and constructed and where the two guides are attached to the inside outer edge of their respective upper ports where each guide shape follows the circumference of said powered spool with the upper end of the guide curve located near but not touching the surface of the film being processed, and (e) a lower film guide comprised of a single curved section designed to bridge the lower port of a film developing and processing chamber pair where the inside edges of the curved section are attached to the outer edge of the respective lower port and where the curve of the guide is designed to lay below and follow the curvature of the powered spool to allow said threading leader assembly and the attached film to be smoothly guided out one of the lower ports and into the adjacent lower ports of a film developing and processing chamber pair.

10. The apparatus as specified in claim 9 wherein said film loading compartment incorporates a spindle for attaching a reel of exposed film.

11. The apparatus as specified in claim 9 wherein said film loading compartment incorporates a means for attaching an exposed film cartridge.

12. The apparatus as specified in claim 9 wherein the threading leader assembly is comprised of a contiguous strip of flexible thin material having on one end a spring clip made of non-corrosive material and where the other end has a curved threading tip and where the upper and lower edge on each side of the strip is thicker than the strip center.

13. The apparatus as specified in claim 9 wherein the first curved segment and the second curved segment have means to allow the segments to be attached to a convenient structural member of said apparatus.

14. The apparatus as specified in claim 9 wherein the first guide and the second guide have means to allow the guides to be attached to the inside outer edge of their respective upper ports.

15. The apparatus as specified in claim 9 wherein the outside film guide of said upper film guide assembly is comprised of a single curved section where the curve is sized to allow the curve edges to be located and attached near the edges of the upper ports of each film developing and processing chamber pair and with the single curved section having an opening that allows a corresponding pinch roller to protrude through the opening and rotate freely.

16. The apparatus as specified in claim 9 wherein the film spools of said powered film spool assembly, when viewed from the end, are circular and when viewed from the side, have an upper and lower concave shape where the edges of the spools have a flat surface.

17. The apparatus as specified in claim 9 wherein the pinch rollers on said pinch-roller assembly, when viewed from the ends are circular and when viewed from the sides have an upper and lower concave shape where the edges of the rollers have a flat surface that is aligned with the respective flat edges on the film spools on said powered film spool assembly and with the thicker edges of said threading leader assembly.

18. A method for automatically threading roll-film through a roll-film processor which comprises the steps of:

(a) inserting an exposed film reel into an exposed film spindle located within a film loading compartment of said roll-film processor, (b) extracting a small section of exposed film from said exposed film reel, (c) attaching the end of the exposed film to a spring clip located on one end of a threading leader assembly, (d) inserting the threading tip located on other end of said threading leader assembly through and out of a film input port located on said film loading compartment, (e) closing a light-proof door attached to said film loading compartment, (f) grasping threading tip projecting out the film input port and manually threading the threading tip into an upper port of a single film developing and processing chamber located at the beginning of a first chamber group, (g) continuing the threading of the threading leader assembly out of a lower port of the single chamber, into a lower port of a second chamber, out of an upper port of the second chamber and into a rolling intersection of a first pinch roller and a first powered film spool located at the upper ports of a first chamber pair of the first chamber group from where the subsequent threading is automatic, (h) allowing film to exit from an upper port of a final film developing and processing chamber at which time an alarm is sounded to alert an operator to turn-off said film processor, and (i) removing the film from said threading leader assembly and winding the film onto a final viewing reel.

* * * * *